US009869316B2

(12) United States Patent
Drechsel et al.

(10) Patent No.: US 9,869,316 B2
(45) Date of Patent: Jan. 16, 2018

(54) PUMP ARRANGEMENT

(71) Applicant: KSB Aktiengesellschaft, Frankenthal (DE)

(72) Inventors: Patrick Drechsel, Frankenthal (DE); Markus Lay, Frankenthal (DE)

(73) Assignee: KSB Aktiengesellschaft, Frankenthal (DE)

( * ) Notice: Subject to any disclaimer, the term of this patent is extended or adjusted under 35 U.S.C. 154(b) by 207 days.

(21) Appl. No.: 14/889,527

(22) PCT Filed: Apr. 29, 2014

(86) PCT No.: PCT/EP2014/058701
§ 371 (c)(1),
(2) Date: Nov. 6, 2015

(87) PCT Pub. No.: WO2014/180711
PCT Pub. Date: Nov. 13, 2014

(65) Prior Publication Data

US 2016/0084255 A1 Mar. 24, 2016

(30) Foreign Application Priority Data

May 8, 2013 (DE) ..... 10 2013 208 536

(51) Int. Cl.
*F04D 13/02* (2006.01)
*F04D 13/06* (2006.01)
(Continued)

(52) U.S. Cl.
CPC ..... *F04D 13/064* (2013.01); *F04D 1/00* (2013.01); *F04D 13/024* (2013.01);
(Continued)

(58) Field of Classification Search
CPC .... F04D 13/024; F04D 13/025; F04D 13/026; F04D 13/027; H02K 5/128; H02K 49/106
(Continued)

(56) References Cited

U.S. PATENT DOCUMENTS 3,195,467 A * 7/1965 Collet ..... F04D 29/047 210/222
5,915,931 A * 6/1999 Lindner ..... H02K 49/106 417/420
6,997,688 B1 * 2/2006 Klein ..... F04D 13/026 417/420

FOREIGN PATENT DOCUMENTS

DE 93 19 713.6 U1 2/1994
DE 42 12 982 C2 4/1996
(Continued)

OTHER PUBLICATIONS

International Preliminary Report on Patentability (PCT/IB/373) issued in PCT Application No. PCT/EP2014/058701 dated Nov. 10, 2015, including English-translation of document C2 (German-language Written Opinion (PCT/ISA/237)) previously filed on Nov. 6, 2015 (seven (7) pages).
(Continued)

*Primary Examiner* — Peter J Bertheaud
(74) *Attorney, Agent, or Firm* — Crowell & Moring LLP

(57) ABSTRACT

A pump arrangement, in particular a magnetic clutch pump arrangement, is provided. The pump arrangement includes a pump housing containing an impeller shaft, a containment shell which seals an enclosed chamber within the inner chamber of the pump housing, an impeller mounted on one end of the impeller shaft, an inner rotor mounted on the other end of the impeller shaft, a drive motor, a drive shaft that can be driven by the drive motor, and an outer rotor which is mounted on the drive shaft and co-operates with the inner rotor. The outer rotor has a hub and a first support element,
(Continued)

and a hollow cylindrical portion between the hub and the first support element.

5 Claims, 3 Drawing Sheets

(51) Int. Cl.

| | |
|---|---|
| ***F04D 1/00*** | (2006.01) |
| ***F04D 17/08*** | (2006.01) |
| ***F04D 25/06*** | (2006.01) |
| ***F04D 29/044*** | (2006.01) |
| ***F04D 29/054*** | (2006.01) |
| ***F04D 29/22*** | (2006.01) |
| ***F04D 29/28*** | (2006.01) |

(52) U.S. Cl.
CPC ..... *F04D 13/025* (2013.01); *F04D 13/0613* (2013.01); *F04D 13/0626* (2013.01); *F04D 17/08* (2013.01); *F04D 25/06* (2013.01); *F04D 29/044* (2013.01); *F04D 29/054* (2013.01); *F04D 29/22* (2013.01); *F04D 29/28* (2013.01)

(58) Field of Classification Search
USPC ..... 417/420, 423.6, 423.7
See application file for complete search history.

(56) References Cited

FOREIGN PATENT DOCUMENTS

| | | | |
|---|---|---|---|
| DE | 690 24 118 | T2 | 7/1996 |
| DE | 298 14 113 | U1 | 11/1998 |
| DE | 42 38 132 | C2 | 10/2002 |
| DE | 102 40 800 | B4 | 3/2005 |
| DE | 195 13 962 | B4 | 6/2007 |
| FR | 2.088.0867 | A5 | 1/1972 |
| WO | WO 2005/017362 | A1 | 2/2005 |

OTHER PUBLICATIONS

International Search Report (PCT/ISA/210) issued in counterpart PCT Application No. PCT/EP2014/058701 dated Jul. 23, 2014 with English-language translation (seven (7) pages).
German-language Written Opinion (PCT/ISA/237) issued in counterpart PCT Application No. PCT/EP2014/058701 dated Jul. 23, 2014 (six (6) pages).
German-language Office Action issued in counterpart German Application No. DE 10 2013 208 536.2 dated Oct. 29, 2013 (five (5) pages).

* cited by examiner

PUMP ARRANGEMENT

CROSS REFERENCE TO RELATED APPLICATIONS

This application is a continuation of PCT International Application No. PCT/EP2014/058701, filed Apr. 29, 2014, which claims priority under 35 U.S.C. §119 from German Patent Application No. 10 2013 208 536.2, filed May 8, 2013, the entire disclosures of which are herein expressly incorporated by reference.

BACKGROUND AND SUMMARY OF THE INVENTION

The invention relates to a pump arrangement, in particular magnetic clutch pump arrangement. The pump arrangement has an interior space formed by a pump casing of the pump arrangement, a containment can which hermetically seals off a chamber surrounded by said containment can with respect to the interior space formed by the pump casing, an impeller shaft which can be driven in rotation about an axis of rotation, an impeller which is arranged on one end of the impeller shaft, an inner rotor arranged on the other end of the impeller shaft, having a drive motor, a drive shaft which can be driven rotatably about the axis of rotation by the drive motor, and an outer rotor which is arranged on the drive shaft and which interacts with the inner rotor, wherein the outer rotor has a hub and a first carrier element.

Pump arrangements of said type are widely used and can be found in almost all sectors of industry. Machines of the present type are also used in explosive environments. For different production and conveying installations, in particular in the chemical sector, there are particular guidelines relating to explosion protection. In such installations, use is made, on the one hand, of working machines, for example pumps or turbines, as non-electrical devices, and on the other hand, of power machines, for example drive motors, as electrical devices. Proven safety standards have existed for a long time for electrical devices. Said standards specify the structural measures that must be implemented in order that an electrical device can be used in the various explosive environments. In areas in which the generation of an explosive atmosphere is possible, ignition sources, that is to say the generation of sparks as a result of friction or impact, friction heat and electrical charging, must be avoided, and possible effects of an explosion must be allowed for by way of preventative and structural measures. Explosion-protected block motors, in particular standard motors of flange-type design, permit only a certain introduction of heat into the motor at the interfaces, in particular flange and shaft, such that the maximum admissible temperatures of the motor are not exceeded.

It has lately become known, in the case of magnetic clutch pump arrangements, that the main introduction of heat into the drive motor takes place through the drive shaft thereof, as the outer magnet carrier of the magnetic clutch is exposed both to the temperature of the media and also to the temperature increase resulting from eddy current losses. The poor heat dissipation from the outer magnet carrier owing to the likewise heated pump casing has the effect that the heat energy is introduced predominantly directly into the drive shaft.

In German patent document no. DE 298 14 113 U1, said problem is circumvented by virtue of the outer rotor, referred to as driver, and the drive motor being connected by way of a drive means composed of a material with low thermal conductivity. A disadvantage here is the expensive embodiment with an interposed outer rotor. This is because, aside from the requirement for additional components, not only the motor rolling bearing but also the deep-groove ball bearings which serve for the mounting of the outer rotor have to be serviced. Furthermore, the heat barrier function exists only at the interface to the motor shaft stub. However, since the heat is introduced directly into the inner ring of the deep-groove ball bearings, expansion of the inner ring and thus bracing of the bearing occur, consequently resulting in a reduction in service life. In the case of an embodiment which acts with coolant, the outer rotor runs in the coolant, giving rise to considerable friction losses, which considerably reduce the efficiency of the pump.

It is the object of the invention to provide a pump arrangement which, in the case of an increased temperature of the medium to be delivered, while simultaneously maintaining the explosion protection of the drive motor, permits a reduction in axial and radial structural space and a simplification of the assembly process.

The object on which the invention is based is achieved in that the outer rotor has a hollow cylindrical section between the hub and the first carrier element.

By virtue of the fact that the hub is arranged not directly on the first carrier element but is connected via the hollow cylindrical section to the drive shaft, the introduction of heat from the outer magnet carrier into the drive shaft, and thus into the drive motor, is reduced.

In one refinement of the invention, the hollow cylindrical section and the hub are of thin-walled form in relation to the first carrier element. The hollow cylindrical section and the hub each have a wall with a certain wall thickness, wherein the wall thickness of the wall of the hollow cylindrical section and the wall thickness of the wall of the hub are smaller than the radius of the drive shaft, and are selected such that, in all situations, reliable torsional and bending fatigue strength is ensured. This leads to a further reduction of the introduction of heat from the outer magnet carrier into the drive shaft of the drive motor.

One advantageous refinement provides that the axial fixing of the outer magnet carrier to the drive shaft is realized by way of a fastening element.

Here, ideally, the fastening element has a first external thread on one end and has a second external thread on the end situated opposite the first external thread, wherein, between the first external thread and the second external thread, there is situated a spacer section, the outer diameter of which is greater than the outer diameter of the first external thread and of the second external thread.

What has proven to be particularly advantageous is a refinement in which the spacer section has, on the side close to the first external thread, a collar of increased outer diameter, whereby the fastening element can be positioned axially in an exact manner and fastened in uncomplicated fashion.

Alternatively, the spacer section may taper off conically at the side close to the first external thread.

It is expediently provided that, in the hub, there is formed a radial threaded bore into which a screw element is screwed. Thus, when the pump arrangement is at a standstill, the hub abuts against the drive shaft at the point which is abutted against by the hub during operation. A high level of true running accuracy is achieved in this way.

Other objects, advantages and novel features of the present invention will become apparent from the following detailed description of one or more preferred embodiments when considered in conjunction with the accompanying drawings.

DETAILED DESCRIPTION

Figure 1:
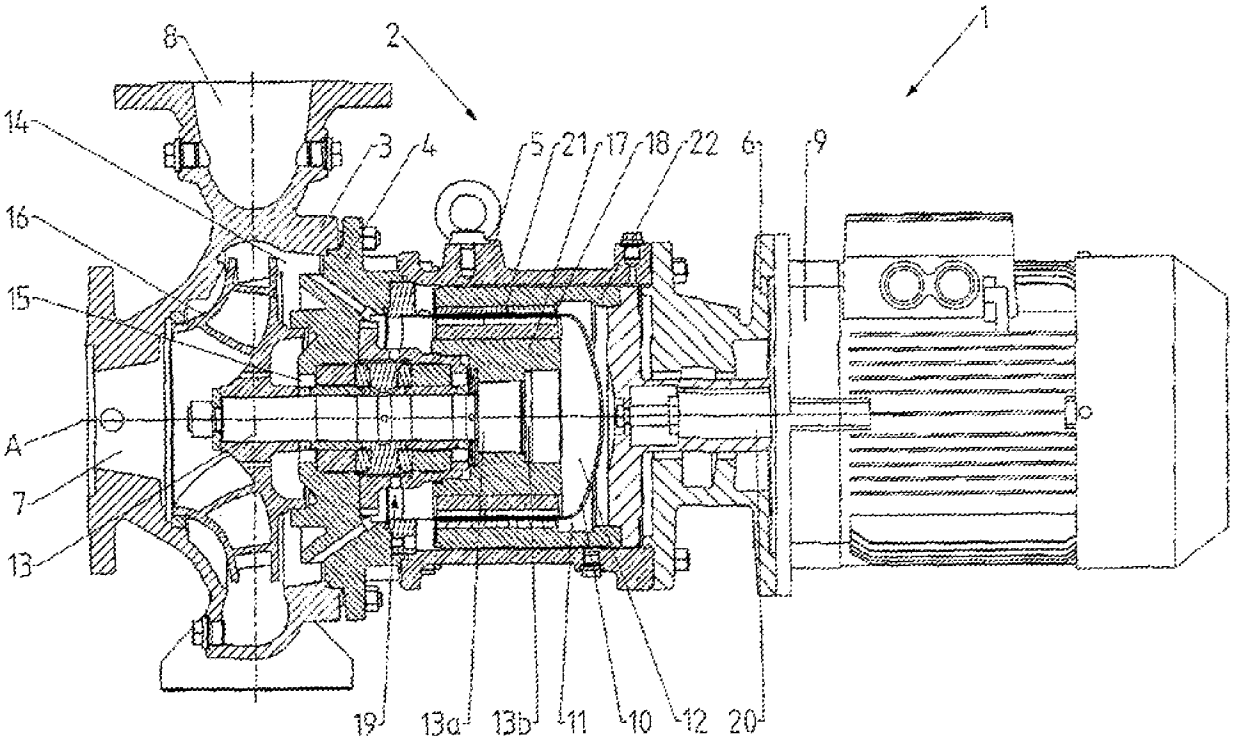
FIG. 1 shows the longitudinal section through a magnetic clutch pump arrangement having an outer rotor according to an embodiment of the invention.

FIG. 1 shows a pump arrangement 1 in the form of a magnetic clutch pump arrangement having a pump part and having an electrical part. The pump part of the pump arrangement 1 has a multi-part pump casing 2 of a centrifugal pump, which pump casing comprises a hydraulics casing 3 designed as a spiral casing, a casing cover 4, a bearing carrier cage 5 and a connecting element 6.

The hydraulics casing 3 has an inlet opening 7 for the intake of a delivery medium and has an outlet opening 8 for the discharge of the delivery medium. The casing cover 4 is arranged on that side of the hydraulics casing 3 which is situated opposite the inlet opening 7. The bearing carrier cage 5 is fastened to that side of the casing cover 4 which is opposite from the hydraulics casing 3. The connecting element 6 is mounted on that side of the bearing carrier cage 5 which is situated opposite the casing cover 4. A drive motor 9, which forms the electrical part, is arranged on the connecting element 6 at the side situated opposite the bearing carrier cage 5.

A containment can 10 is fastened to that side of the casing cover 4 which is opposite from the hydraulics casing 3, and said containment can extends at least partially through an interior space 11 delimited by the pump casing 2, in particular by the casing cover 4, by the bearing carrier cage 5 and by the connecting element 6. The containment can 10 hermetically seals off a chamber 12, which is enclosed by said containment can, with respect to the interior space 11.

An impeller shaft 13 which is rotatable about an axis of rotation A extends from a flow chamber 14, which is delimited by the hydraulics casing 3 and by the casing cover 4, into the chamber 12 through an opening 15 provided in the casing cover 4.

An impeller 16 is fastened to a shaft end, situated within the flow chamber 14, of the impeller shaft 13, and an inner rotor 17 arranged within the chamber 12 is arranged on the opposite shaft end, which has two shaft sections 13*a*, 13*b* with increasing diameters in each case. The inner rotor 17 is equipped with multiple magnets 18 which are arranged on that side of the inner rotor 17 which faces toward the containment can 10.

Between the impeller 16 and the inner rotor 17 there is arranged a bearing arrangement 19 which is operatively connected to the impeller shaft 13, which can be driven in rotation about the axis of rotation A.

The drive motor 9 comprises a drive shaft 20. The drive shaft 20, which can be driven about the axis of rotation A, is arranged substantially coaxially with respect to the impeller shaft 13. The drive shaft 20 extends into the connecting element 6 and possibly at least partially into the bearing carrier cage 5. On the free end of the drive shaft 20 there is arranged an outer rotor 22, which bears multiple magnets 21. The magnets 21 are arranged on that side of the outer rotor 22 which faces toward the containment can 10. The outer rotor 22 extends at least partially over the containment can 10 and interacts with the inner rotor 17 such that the rotating outer rotor 22, by way of magnetic forces, sets the inner rotor 17 and thus likewise the impeller shaft 13 and the impeller 16 in rotation.

Figure 2:
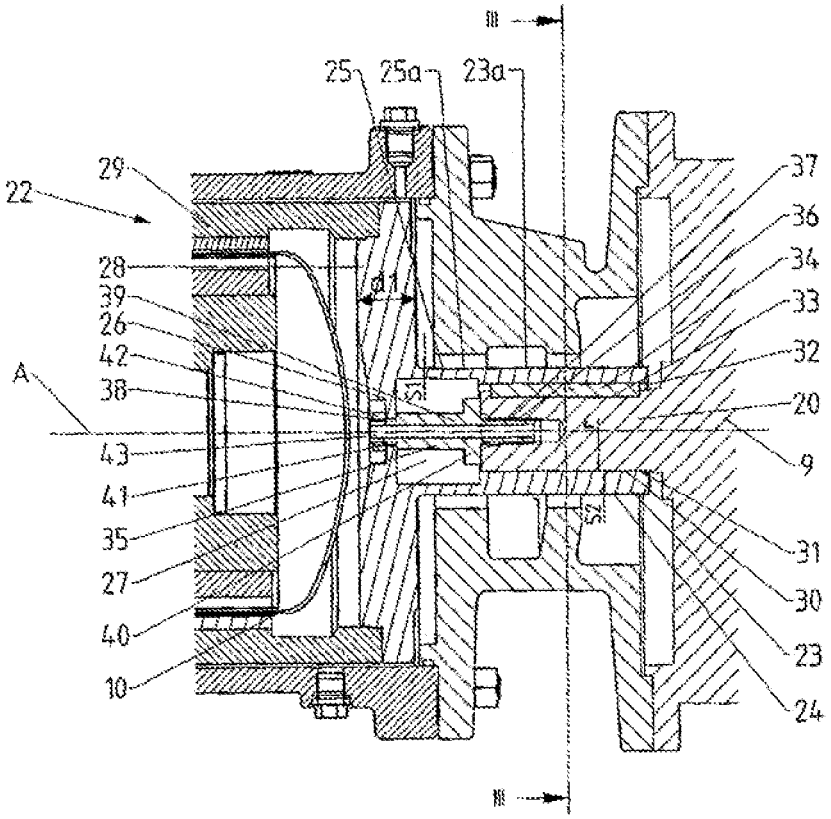
FIG. 2 shows an outer rotor, corresponding to FIG. 1, in an enlarged illustration.

The outer rotor 22, which is illustrated on an enlarged scale in FIG. 2, comprises a hub 23 with an outer shell surface 24, and a hollow cylindrical section 25 formed on that side of the hub 23 which faces away from the drive motor 9, which hollow cylindrical section has a cell 27 delimited by a wall 26. The outer rotor 22 furthermore comprises a flange-like first carrier element 28, which is formed or arranged on that side of the hollow cylindrical section 25 which faces toward the containment can 10, and a hollow cylindrical second carrier element 29, which is formed or arranged on the first carrier element 28 and which at least partially surrounds the containment can 10 and on which the magnets 21 are arranged. The first and second carrier elements 28, 29 are illustrated as two interconnectable parts, though may also be produced as one part.

The hollow cylindrical section 25 has a wall 25*a* with a wall thickness S1, and the hub 23 has a wall 23*a* with a wall thickness S2. The hollow cylindrical section 25 and the hub 23 are of thin-walled form in relation to the first carrier element 28. The wall thicknesses S1, S2 are much smaller than the thickness d1 of the first carrier element 28. The wall thickness S1 of the wall 25*a* of the hollow cylindrical section 25 and the wall thickness S2 of the wall 23*a* of the hub 23 are selected such that, in all situations, reliable torsional and bending fatigue strength is ensured. The wall thicknesses S1, S2 are furthermore smaller than the radius r of the drive shaft 20. The wall thickness S1 of the wall 25*a* is preferably smaller than the wall thickness S2 of the wall 23*a*.

A passage bore 30 extends through the hub 23 into the cell 27 of the hollow cylindrical section 25 arranged between the hub 23 and the first carrier element 28, said passage bore forming a hub inner surface 31. An axial groove 32 which extends parallel to the axis of rotation A is provided in the hub inner surface 31. In the drive shaft 20 there is formed a feather key groove 33 which is oriented toward the axial groove 32 and into which a feather key 34 is inserted for the transmission of the motor torque to the hub 23 of the outer rotor 22. The axial fixing of the outer rotor 22 to the drive shaft 20 is realized by way of a fastening element 35.

The fastening element 35 has, on one end, a first external thread 37, which can be screwed into a threaded bore 36 formed on the face side of the drive shaft 20 so as to be coaxial with the axis of rotation A, and, on the end situated opposite the first external thread 37, a second external thread 38. Between the first external thread 37 and the second external thread 38 there is formed a spacer section 39, the outer diameter of which is greater than the outer diameter of the first external thread 37 and of the second external thread 38.

The fastening element 35 is screwed by way of the first external thread 37 into the threaded bore 36 until the spacer section 39 abuts against the face side of the drive shaft 20. In the embodiment shown in FIGS. 1 and 2, the spacer section 39 has, on the side close to the first external thread 37, a collar 40 of increased outer diameter, which collar bears against the drive shaft 20. The collar 40 is preferably of hexagonal form, or has at least two wrench flats. Alternatively, the spacer section 39 may taper off conically at the side close to the first external thread 37 and come into abutment against the conical entry region of the threaded bore 36.

The second external thread 38 extends through an opening 41 in the wall 26, wherein the spacer section 39 of the fastening element 35 is in abutment against the wall 26. The axial fixing of the outer rotor 22 to the drive shaft 20 is realized by way of a threaded nut 42 screwed onto the second external thread 38. In this way, the outer rotor 22 can be positioned axially in an exact manner and fastened in a simple manner. Furthermore, a passage bore 43 extends from one face side of the fastening element 35 to the other in order to minimize the material that transmits the heat from the outer rotor 22 into the drive shaft 20. Alternatively, instead of the passage bore 43, a blind bore may be provided which extends either from the face side close to the first external thread 37 as far as a point close to or in the spacer section 39, or from the face side close to the second external thread 38 as far as the collar 40 or beyond.

Figure 3:
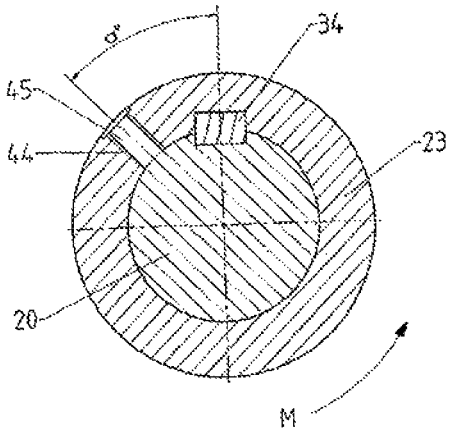
FIG. 3 shows a section along the line III-III from FIG. 2.

FIG. 3 shows that, in the hub 23, there is formed a radial threaded bore 44 into which a screw element 45, in particular a grub screw, is screwed. That end of the screw element 45 which faces toward the drive shaft 20 is preferably of frustoconical form. The threaded bore 44 is always arranged at an angle $\alpha$ of approximately 35° to approximately 55°, and preferably at an angle $\alpha$ of 40° to 50°, and preferably at an angle a of approximately 45°, with respect to the axial groove 32 in the direction of rotation of the driven drive shaft 20, indicated here by the arrow M. If required, further threaded bores 44 (not illustrated) are provided in the hub 23 along its axial extent.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE DESIGNATIONS

1 Pump arrangement
2 Pump casing
3 Hydraulics casing
4 Casing cover
5 Bearing carrier cage
6 Connecting element
7 Inlet opening
8 Outlet opening
9 Drive motor
10 Containment can
11 Interior space
12 Chamber
13 Impeller shaft
13*a* Shaft section
13*b* Shaft section
14 Flow chamber
15 Opening
16 Impeller
17 Inner rotor
18 Magnet
19 Bearing arrangement
20 Drive shaft
21 Magnet
22 Outer rotor
23 Hub
23*a* Wall
24 Outer shell surface
25 Hollow cylindrical section
25*a* Wall
26 Wall
27 Cell
28 First carrier element
29 Second carrier element
30 Passage bore
31 Hub inner surface
32 Axial groove
33 Feather key groove
34 Feather key
35 Fastening element
36 Threaded bore
37 First external thread
38 Second external thread
39 Spacer section
40 Collar
41 Opening
42 Threaded nut
43 Passage bore
44 Threaded bore
45 Screw element
A Axis of rotation
S1 Wall thickness of hollow cylindrical section
S2 Wall thickness of hub
r Radius of drive shaft

The invention claimed is:

1. A pump arrangement, comprising:
a pump casing having an interior space;
a containment can having a central longitudinal axis and being arranged to hermetically seal a chamber in the interior space;
an impeller shaft;
an impeller arranged on a impeller end of the impeller shaft;
an inner rotor arranged within the containment can on an opposite end of the impeller shaft;
an outer rotor arranged radially outside of the containment can and axially located to interact with the inner rotor,
a drive motor, and
a drive shaft arranged to be driven by the drive motor and to be coupled to the outer rotor,
wherein
the outer rotor includes a hub and a first carrier element, and a hollow cylindrical section between the hub and the first carrier element,
the outer rotor is coupled to the drive shaft by a fastening element, and
the fastening element has
a first external thread on a first end facing the drive shaft,
a second external thread on a second end opposite the first end, and
a spacer section between the first external thread and the second external thread having an outer diameter greater than outer diameters of the first external thread and the second external thread.

2. The pump arrangement as claimed in claim 1, wherein the hollow cylindrical section and the hub are thin-walled relative to a thickness of the first carrier element parallel to the central longitudinal axis.

3. The pump arrangement as claimed in claim 1, wherein the spacer section includes a collar of increased outer diameter on a first external thread side.

4. The pump arrangement as claimed in claim 3, wherein the spacer section includes a conical taper off on the first external thread side.

5. The pump arrangement as claimed in claim 1, wherein the hub includes a radial threaded bore configured to receive a screw element such that the screw element abuts an outer surface of the drive shaft.

* * * * *